US005996600A

United States Patent [19]

Ostry

[11] Patent Number: 5,996,600

[45] Date of Patent: Dec. 7, 1999

[54] CHEMICAL JUG RINSER

[76] Inventor: David L. Ostry, 3042 Country Rd. S., Prague, Nebr. 68050

[21] Appl. No.: 09/133,175

[22] Filed: Aug. 13, 1998

[51] Int. Cl.[6] ..... B08B 3/02; B08B 9/08

[52] U.S. Cl. ..... 134/169 R

[58] Field of Search ..... 134/166 R, 167 R, 134/168 R, 169 R

[56] References Cited

U.S. PATENT DOCUMENTS

| | | | |
|---|---|---|---|
| 1,730,658 | 10/1929 | Jensen | 134/168 R |
| 3,092,120 | 6/1963 | Hilger et al. . | |
| 3,120,237 | 2/1964 | Lang | 134/167 R X |
| 3,990,909 | 11/1976 | Peckham | 134/168 R |
| 4,872,467 | 10/1989 | Ballu | 134/166 R X |
| 5,277,208 | 1/1994 | Mansur . | |
| 5,419,348 | 5/1995 | Kuta . | |
| 5,507,060 | 4/1996 | Quimpo . | |
| 5,640,643 | 6/1997 | Hoitz et al. | 134/166 R X |

FOREIGN PATENT DOCUMENTS

| | | | |
|---|---|---|---|
| 623270 | 7/1961 | Canada | 134/168 R |
| 53777 | 10/1890 | Germany | 134/166 R |

*Primary Examiner*—Philip R. Coe
*Attorney, Agent, or Firm*—Patent & Trademark Services; Joseph H. McGlynn

[57] ABSTRACT

A washing system for containers that have been used for chemicals or herbicides. The system has a source of water which is directed into the containers by a wand with a plurality of slots to direct the water against the inside of the container, and a collection system which collects and transfers the used water to a chemical storage tank.

7 Claims, 1 Drawing Sheet

CHEMICAL JUG RINSER

BACKGROUND OF THE INVENTION

This invention relates, in general, to rinsing system, and, in particular, to a rinsing system for jugs which have been used to store chemicals.

DESCRIPTION OF THE PRIOR ART

In the prior art various types of rinsing systems have been proposed. For example, U.S. Pat. No. 3,092,120 to Hilger et al discloses a washer for cups having a platform to support the cup and a source of water which will be directed into the inside of the cup and a drain for the used water.

U.S. Pat. No. 5,277,208 to Mansur discloses a self-contained power spray washer with a central chamber having a turntable to rotate the item to be washed, a power spray water supply to inject water at high pressure, a fresh water rinse cycle and a drain to dispose of the used water.

U.S. Pat. No. 5,419,348 to Kuta discloses a bottle washing machine with a nozzle spray to introduce water into the inside of the bottle, and means to rotate the bottle as it is being cleaned.

U.S. Pat. No. 5,507,060 to Quimpo discloses an apparatus for cleaning baby bottles comprising a plurality of bottle holders for rotating the bottles, a spray for injecting water into the bottles and a drain for the used water.

SUMMARY OF THE INVENTION

The present invention is directed to a washing system for containers that have been used for chemicals or herbicides. The system has a source of water which is directed into the containers by a wand with a plurality of slots to direct the water against the inside of the container, and a collection system which collects and transfers the used water to a chemical storage tank.

It is an object of the present invention to provide a new and improved washing system for containers which have been used for chemicals or herbicides.

It is an object of the present invention to provide a new and improved washing system which is inexpensive, easily connected to the containers, and which will collect the used washing medium for proper disposal.

These and other objects and advantages of the present invention will be fully apparent from the following description, when taken in connection with the annexed drawings.

DESCRIPTION OF THE PREFERRED EMBODIMENT

Figures 1, 2:
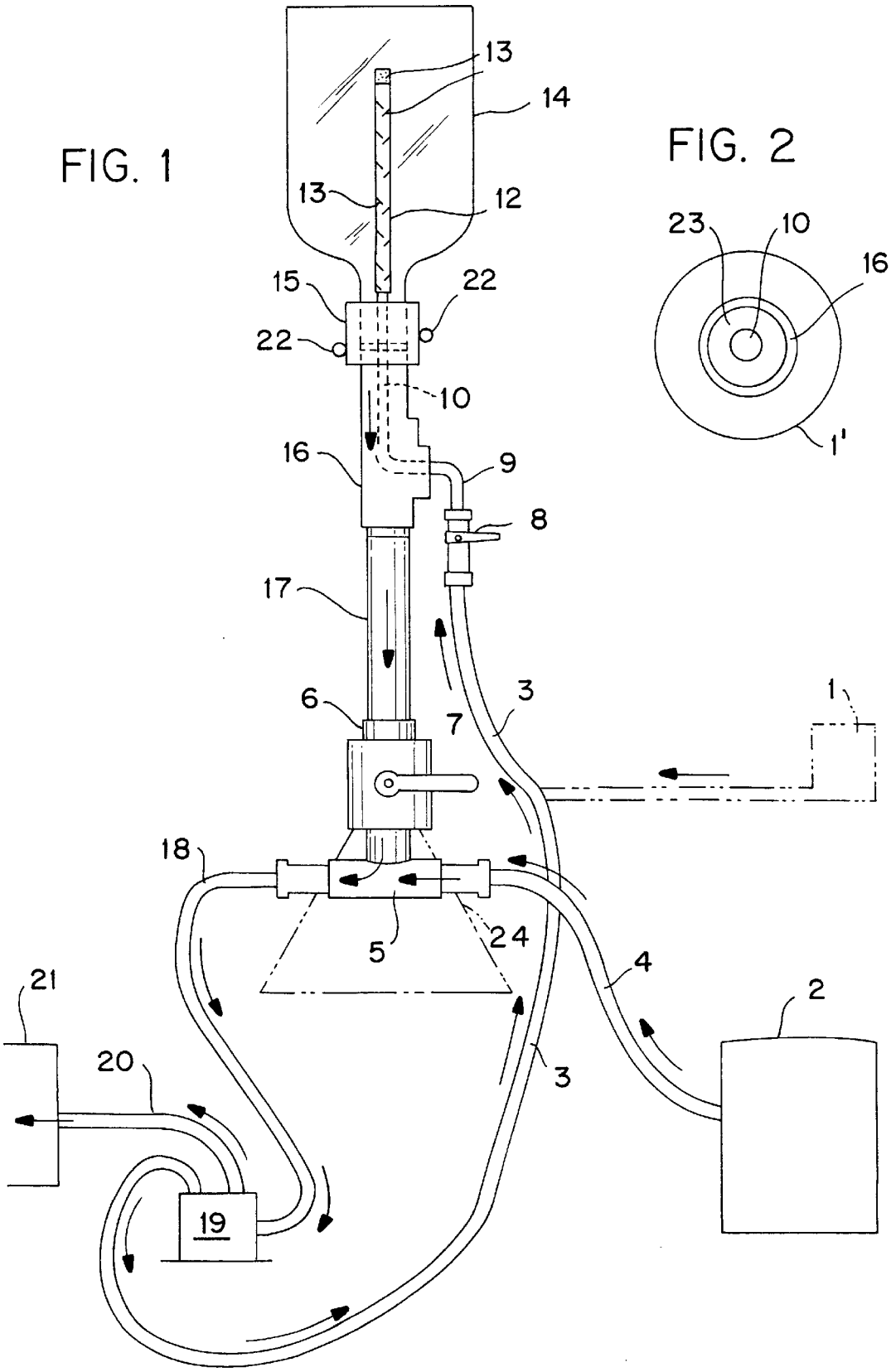
FIG. 1 is a view of the components of the washing system of the present invention.
FIG. 2 is a top view of a drain disk used with the present invention.

Referring now to the drawings in greater detail, FIG. 1 shows the components which make up the washing system of the present invention. The Environmental Protection Agency (EPA) requires users of containers that have been used with chemicals and/or herbicides to triple rinse the containers. This is a very time consuming process. In addition, the process of rinsing is dangerous since there is a risk of getting the chemicals and/or herbicides on the users clothing, hands, eyes and face. The present invention is designed to reduce this time consuming process, and at the same time make it safe both for the user and the environment.

The present system shown in FIG. 1 depicts a normal applicator tank 21 which will be used to apply water to a field. The present invention can be incorporated into the normal watering system and used to rinse container which have held chemicals. Water is taken from a water source such as a supply tank 1 or in the alternative water can be taken from a hydrant 2, and transferred, by means of pump 19 to applicator tank 21.

In order to use this normal water applicator system to rinse chemical containers 14, the water, from either source 1 or 2, is passed into the system by way of tubes or hoses 3, through a shut off valve 8, which can be any conventional valve. Leading out of valve 8 is a pipe 9 which passes through a main body 16 and connects with a vertical pipe 10. The pipe 10 passes through a seal 15 and then connects with a wand 12 which is located within a container 14 to be cleaned or rinsed.

A seal 15, of any conventional design is attached to the main body 16, section 16, by means of a pipe clamp 22, and seals the inlet of the main container 14 which slips into seal 15 and main body 16 so any water inside the container will not leak out.

The wand 12 is essentially a hollow tube which has a slit 13 at one end to allow water to exit from the wand into the container 14, and the other end is connected to pipe 10. Spaced along the length of the wand 12 is a plurality of additional angled slits 13 which, when the water is turned on, will direct the water to all interior portions of the container 14. The slits 13 will extend at an angle less than 90° to the longitudinal axis of the disbursing wand 12 in order to direct water to all portions of the inside of the container 14.

When water is introduced into the container 14 it will strike the sides and bottom of the container, thus rinsing any chemicals or herbicides that may be in the container. As the water drains down the sides of the container, it will pass through open area 23 positioned around the pipe 10 in the seal 15. From there it will be pulled through the main body 16, through pipe 17 and then through tube or hose 18 by means of a transfer pump 19. The transfer pump can be of any conventional design that will perform the intended function. The pump 19 will then transfer the waste water and any chemicals therein to applicator tank 21.

An alternative or backup water source 2 can be used as a substitute or additional water source to the main water source 1. Water source 2 is a bulk water tank that can store 1000–1500 gallons of water and can introduce water through pipe or hose 4, through fitting 5 and then into the hose 18 and into applicator tank, where the water will be pulled from the tank by the transfer pump. The valve 7 connected to fitting 6 would be used to either allow water from the rinser to enter the flow of water from the bulk tank to the applicator or to prevent water from the rinser from entering the flow line. It should be noted that valve 7 must be opened before valve 8 in order to prevent back pressure on the jug.

In the alternative, instead of having the rinsing system as a stand alone system mounted on a support stand 24, it could be mounted on an existing chemical mixing cone that is used to mix chemicals. This would reduce the cost of the system as the stand 24, 5, 17, 7 could be eliminated. Also, it should be noted that the chemical mixing cone is not part of my invention, and my invention is adapted to be used with the existing chemical mixing cone.

The arrows show the path that water will take as it moves through the system.

Although the Chemical Jug Rinser and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A washing system for containers which have been used chemicals, said system comprising:

a source of water, means for transferring water to a main body, said main body having a supply pipe connected centrally within said main body, drain areas extending between an outside surface of said supply pipe and an internal surface of said main body, a container attached to said main body, said supply pipe being connected to a disbursing wand for spraying water into said container, seal means attached to said main body and said container for preventing any water in said container from leaking, means connected to said main body for removing water from said container and wherein said main body has a drain plate affixed thereto, said drain plate having a central aperture extending therethrough, said supply pipe extending through said central aperture, and said drain plate having an open area surrounding said central aperture and extending through said drain plate, said open area communicating with said drain areas and extending between an outside surface of said supply pipe and an internal surface of said main body.

2. The washing system for containers as claimed in claim 1, wherein said means connected to said main body for removing water from said container is a transfer pump.

3. The washing system for containers as claimed in claim 2, wherein said transfer pump is connected to a storage container and water removed from said container is moved by said transfer pump to said storage container.

4. The washing system for containers as claimed in claim 1, wherein a shut off valve is positioned in said means for transferring water to said main body between said water source and said main body.

5. The washing system for containers as claimed in claim 1, wherein said seal means is attached at one end to an external surface of said main body and at another end to an external portion of said container.

6. The washing system for containers as claimed in claim 1, wherein said disbursing wand has a longitudinal axis and there are a plurality of openings in said disbursing wand which extend at an angle of less than 90° to said longitudinal axis, and wherein said wand has at least one additional opening in its end.

7. The washing system for containers as claimed in claim 6, wherein said openings in said disbursing wand are slits.

* * * * *